US010935347B2

(12) United States Patent
Reis Green

(10) Patent No.: US 10,935,347 B2
(45) Date of Patent: Mar. 2, 2021

(54) SCOPE MOUNT FOR ACCESSORY ATTACHMENTS

(71) Applicant: Austin Reis Green, Watertown, WI (US)

(72) Inventor: Austin Reis Green, Watertown, WI (US)

( * ) Notice: Subject to any disclaimer, the term of this patent is extended or adjusted under 35 U.S.C. 154(b) by 0 days.

(21) Appl. No.: 16/517,857

(22) Filed: Jul. 22, 2019

(65) Prior Publication Data

US 2021/0025676 A1 Jan. 28, 2021

(51) Int. Cl.
*F41G 1/38* (2006.01)
*F41G 11/00* (2006.01)

(52) U.S. Cl.
CPC ..... *F41G 11/001* (2013.01); *F41G 1/38* (2013.01)

(58) Field of Classification Search
CPC . F41G 1/387; F41G 1/393; F41G 1/38; F41G 11/001; F41G 11/00; F41G 11/003; F41G 11/004; F41G 1/35; F41G 1/36; F16B 2/12
USPC ..... 89/119, 124, 125, 126, 127
See application file for complete search history.

(56) References Cited

U.S. PATENT DOCUMENTS

| | | | | |
|---|---|---|---|---|
| 2,078,858 | A | 4/1937 | Kuhn | |
| 3,424,420 | A | 1/1969 | Seiderman | |
| 5,606,818 | A | 3/1997 | Hardee | |
| 7,272,904 | B2 | 9/2007 | Larue | |
| D639,376 | S * | 6/2011 | Ding | D22/108 |
| 8,141,288 | B2 * | 3/2012 | Dodd | F41C 23/22 42/84 |
| 8,397,421 | B2 * | 3/2013 | Ding | F41G 11/003 42/124 |
| 8,656,624 | B2 | 2/2014 | Holmberg | |
| 8,733,011 | B2 | 5/2014 | Spuhr | |
| 9,441,915 | B2 | 9/2016 | Zimmer | |
| 10,663,353 | B2 * | 5/2020 | Newlin | F16B 2/065 |
| 2003/0154641 | A1 | 8/2003 | Stover | |
| 2009/0307956 | A1 * | 12/2009 | Barret | F41G 11/003 42/125 |
| 2013/0283663 | A1 * | 10/2013 | Joplin | F41G 11/003 42/124 |
| 2014/0157648 | A1 * | 6/2014 | Haering | F41G 11/005 42/125 |
| 2014/0259854 | A1 * | 9/2014 | Williams | F41G 11/003 42/124 |
| 2016/0377385 | A1 * | 12/2016 | Culp | F41G 11/003 42/126 |
| 2018/0058813 | A1 * | 3/2018 | Minor | F41G 1/387 |
| 2019/0011227 | A1 | 1/2019 | Geissele | |

FOREIGN PATENT DOCUMENTS

WO WO-2016019305 A2 * 2/2016 ..... F41A 17/56

* cited by examiner

*Primary Examiner* — Stephen Johnson
(74) *Attorney, Agent, or Firm* — Dunlap Bennett & Ludwig, PLLC

(57) ABSTRACT

A sight mount for firearms includes a pair of sight rings each including a top ring half joined to a base ring half at interfacing surfaces. The interfacing surfaces define a first split and a second split, each disposed along horizontal planes that are vertically offset from one another. The pair of sight rings define an internal bore for supporting a riflescope. The offset split interface allows a plurality of planar attachment surfaces to be integrated for ambidextrous mounting of accessories.

20 Claims, 5 Drawing Sheets

SCOPE MOUNT FOR ACCESSORY ATTACHMENTS

BACKGROUND OF THE INVENTION

The present invention relates to scope mounts and, more particularly, to a scope mount that allows for desirable ambidextrous modularity for accessory attachments.

Rifles have carried optical sights since the mid 1800's. The first successful telescopic sight mount was invented by John R. Chapman, an English civil engineer. These early telescopic sights featured adjustable mounts, because the telescopic sights did not have internal adjustments. In 1935 Kuhn Fredrick Albert of the Lyman Gun Sight Corporation filed U.S. Pat. No. 2,078,858A, for the first internally adjustable riflescope, a significant patent which transitioned the riflescope mounting solutions to their currently popular, fixed mounting style. Most are horizontally split ring designs like the design found in U.S. Pub. No. 2003/0154641. Another common design is vertically split rings as found in U.S. Pat. No. 7,272,904.

Optical sights permit the shooter to precisely aim the rifle at great distances but often have limiting fields of view and are slow for situations when targets present themselves rapidly at short distances, such as hunting, military combat, and 3-Gun or other competition shooting. It has recently become popular to mount secondary optical sighting systems to riflescopes to enhance the speed of target engagement at these short distances, which impair the function of the primary riflescope. U.S. Pat. No. 5,606,818 teaches a secondary optic mount heavily and clumsily deriving a secondary optical mount function in a separate interface to the parent firearm base rail. The device addresses the need for a second short range targeting system capable of being mounted offset to the right or left side of the firearm, but fails to provide a light, cost effective, or integrated solution.

Angle mounted secondary sighting systems are currently popular in 3-gun competition, and with law enforcement and sport shooters. Griffin Armament as an example designed and produced a micro modular iron sight product offered in a deployment kit, supporting vertical, as well as left and right hand angular offset configurations. The company has sold several thousand sets of the product that allow left- and right-hand users to roll the rifle a number of degrees to transition rapidly from a slow, dirty, or damaged magnified primary optic, to a useable short to medium range secondary sighting system. It is similarly common for modern shooters to use small optical dot sights such as the Trijicon RMR on angular mounts for rapid secondary sighting systems.

A modular scope mount assembly in U.S. Pat. No. 9,441,915 has offset capability only and cannot support top mounted devices such as the SIMRAD night vision device, or the Wilcox Raptar laser aimer and laser rangefinder. The accessory attachment system compromises the one-piece integrity of the scope mount by stacking the mount base and rings on top of the attachment base for the accessory system.

In U.S. Pub. No. 2019/0011227, a system includes a single accessory bolted to the top and front of the scope ring. This system doesn't offer offset angular solutions, or ambidextrous functionality.

In U.S. Pat. No. 8,733,011, a diagonally split ring interface scope mount includes accessory mounting points for interfacing accessory mounting devices. The diagonally split interface does not allow desirable ambidextrous modularity to occur. The top left 45-degree quadrant is occupied by the clamping screws and therefore missing interfacing geometry needed for the ideal 180 degree pattern which affords interfacing geometry needed for compatibility with left and right handed shooters.

As can be seen, there is a need for a scope mount that allows for desirable ambidextrous modularity for accessory attachments.

SUMMARY OF THE INVENTION

In one aspect of the present invention, a sight mount for firearms comprises: a pair of sight rings each comprising: a base ring half; and a top ring half joined to the base ring half at interfacing surfaces, wherein the interfacing surfaces define a first split and a second split each disposed along horizontal planes that are vertically offset from one another.

In another aspect of the present invention, a sight mount for firearms comprises: a pair of sight rings each comprising: a base ring half; and a top ring half joined to the base ring half at interfacing surfaces, wherein the interfacing surfaces define a first split and a second split each disposed along horizontal planes that are vertically offset from one another, the pair of sight rings each comprise a plurality of accessory mounting surfaces comprising a top surface disposed along a horizontal plane, a first side surface and a second side surface each disposed along vertical planes, and a first angled surface and a second angled surface each disposed along angled planes.

These and other features, aspects and advantages of the present invention will become better understood with reference to the following drawings, description and claims.

DETAILED DESCRIPTION OF THE INVENTION

Figure 2B:
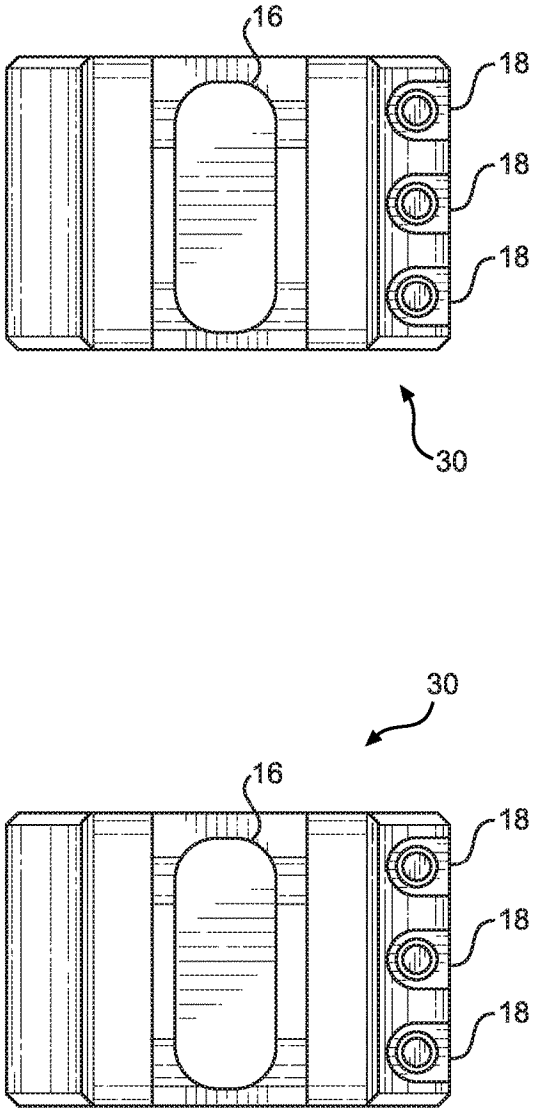
FIG. 2B is a bottom view of an embodiment of the present invention.
Figure 2A:
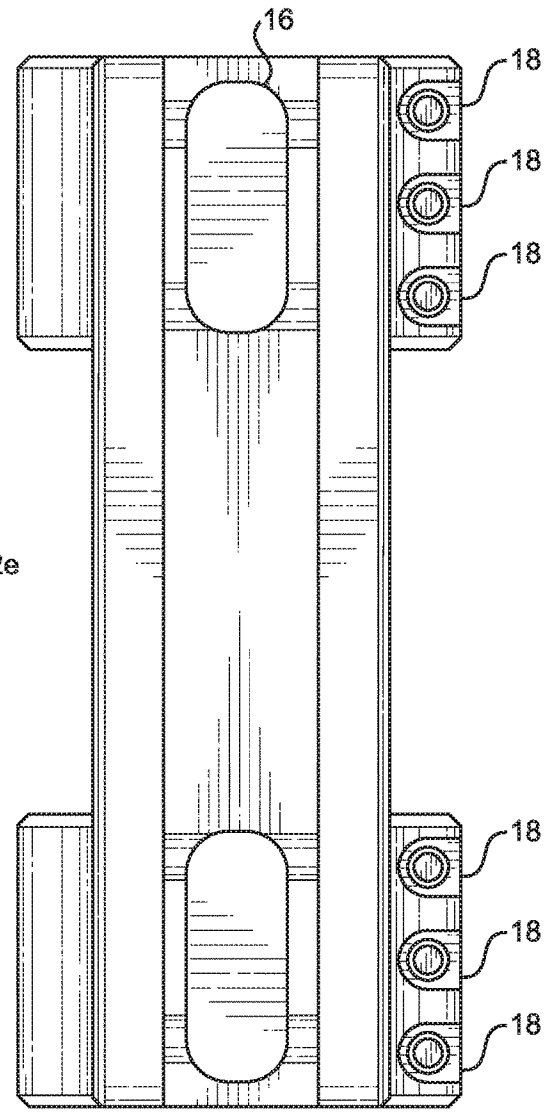
FIG. 2A is a bottom view of an embodiment of the present invention.
Figure 1:
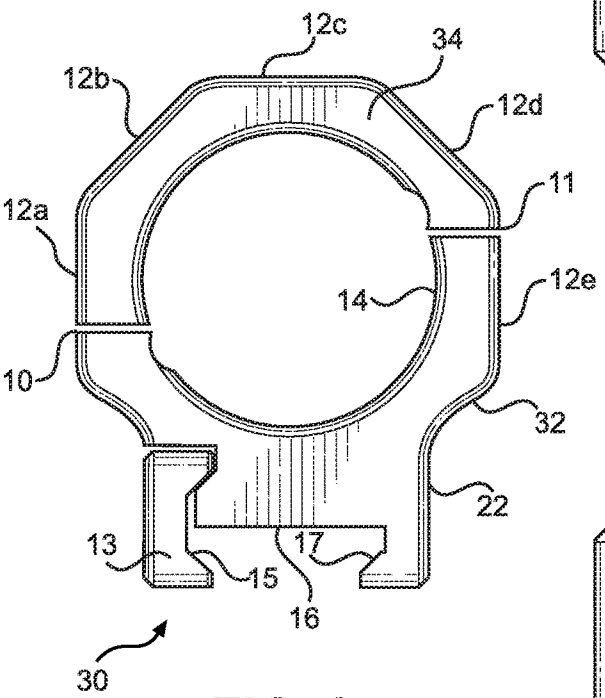
FIG. 1 is a front view of an embodiment of the present invention.
Figure 3A:
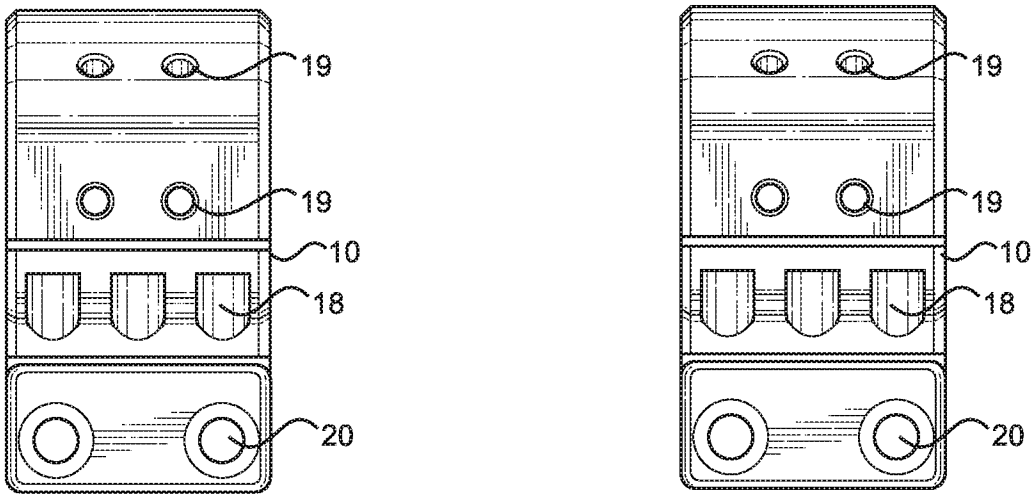
FIG. 3A is a side view of an embodiment of the present invention.
Figure 3B:
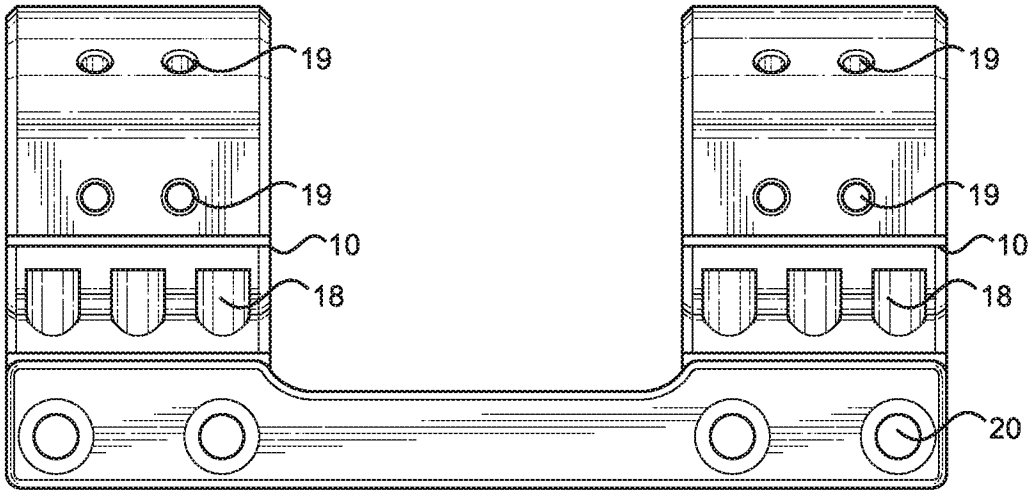
FIG. 3B is a side view of an embodiment of the present invention.
Figure 4A:
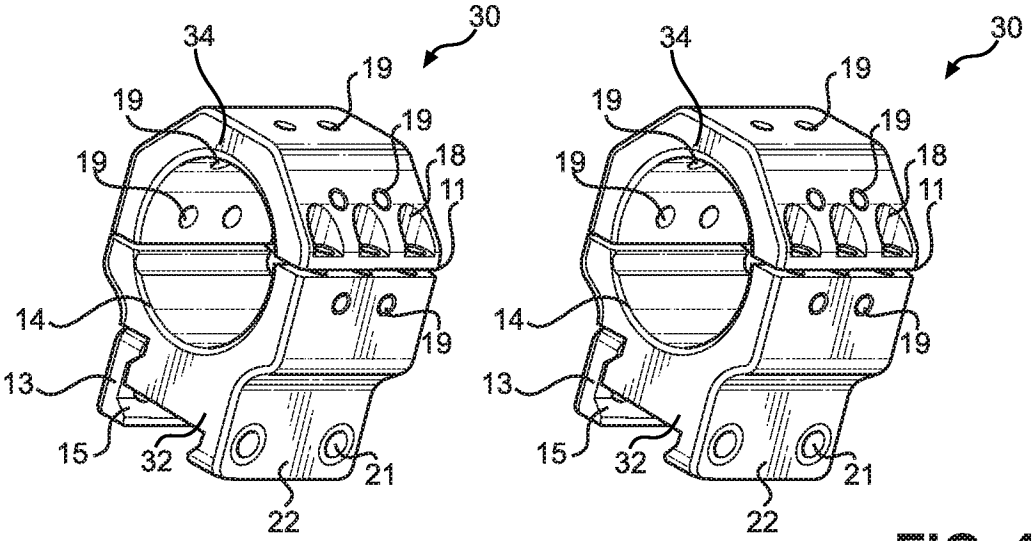
FIG. 4A is a perspective view of an embodiment of the present invention.
Figure 4B:
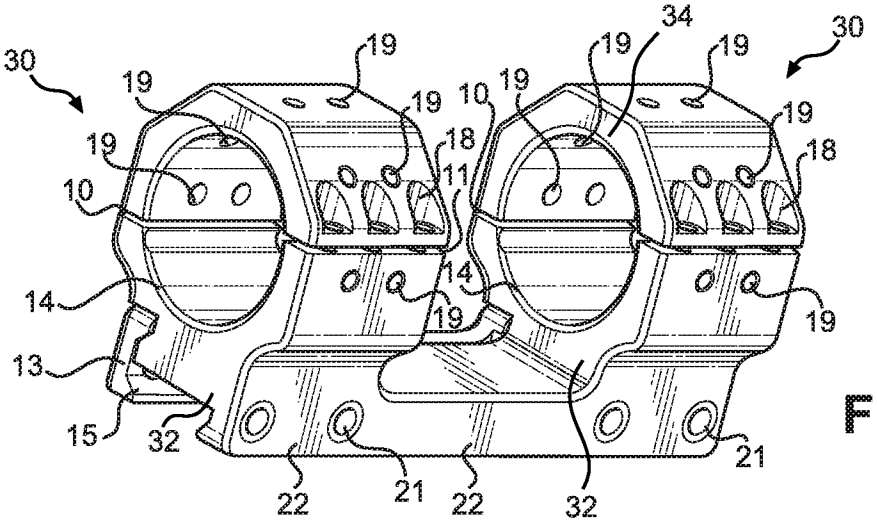
FIG. 4B is a perspective view of an embodiment of the present invention.
Figure 5B:
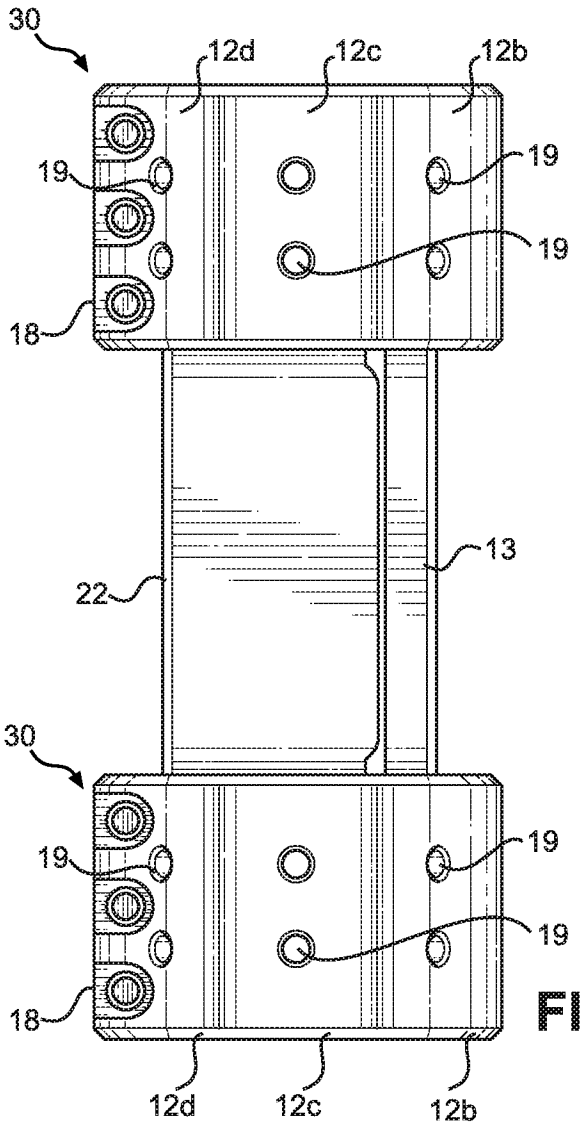
FIG. 5B is a top view of an embodiment of the present invention.
Figure 5A:
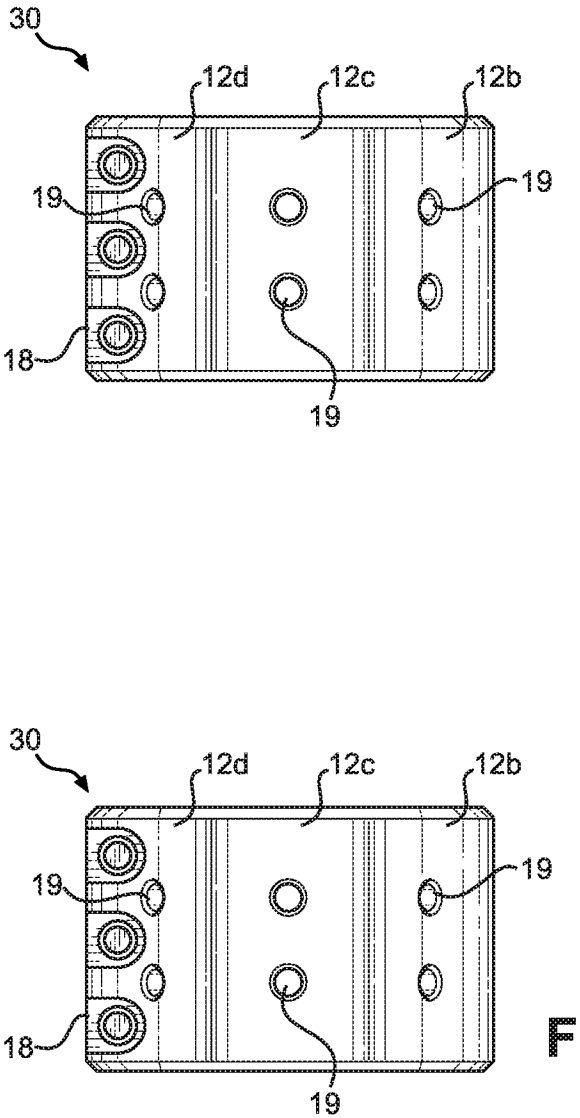
FIG. 5A is a top view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a robust, precision scope mounting system that includes ring tops created by bisecting the mount with one cut on each side, each cut in horizontal planes of different vertical disposition, to allow up to five accessory mounting interface surfaces per mounting ring. Screws clamp the rings from the top on the first side, and from the bottom on the second side. The screw clamped and dual plane split ring design allows ambidextrous layout of accessory interfaces. The five accessory surfaces are located in forty-five degree increments from the left to right side of the mounting system, supporting left and right handed shooters identically. Accessory plate support affords the ability to mount a host of small secondary optical sighting systems, night vision devices, IR laser aimers, IR laser illuminators, laser rangefinders, ball and bubble levels, ballistic data cards, and other devices. Scope removal or dismounting is not required in order to mount accessories.

The attachment interfaces may be at 270° (left), 315° (angled left), 0° (top), 45° (angled right), and 90° (right) positions relative to a center line of the rifle scope for comprehensive support of myriad accessories to be placed in positions of the shooters anatomical and personal preference, affording greater mounting flexibility than any system currently available.

Referring to FIGS. 1 through 6B, the present invention includes a sight mount for firearms. The sight mount includes a pair of sight rings 30 each including a top ring half 34 joined to a base ring half 32 at interfacing surfaces. The interfacing surfaces define a first split 10 and a second split 11 each disposed along horizontal planes that are vertically offset from one another. The pair of sight rings 30 define an internal bore 14 for supporting a riflescope 29.

The pair of sight rings 30 may include five planar accessory mounting surfaces. The accessory mounting surfaces may include a top surface 12*c* disposed along a horizontal plane, a first side surface 12*a* and a second side surface 12*e* each disposed along vertical planes, and a first angled surface 12*b* and a second angled surface 12*d* each disposed along angled planes. The accessory mounting surfaces may include integrated accessory mounts, such as picatinny rails. Alternatively, each of the accessory mounting surfaces includes threaded openings 19 configured to receive bolts for coupling accessory adaptor plates 24 thereto.

In certain embodiments, the first split 10 is disposed at a bottom of the first side surface 12*b*, and the second split 11 is disposed at a top of the second side surface 12*e* so that the first split 10 and the second split 11 are disposed along horizontal planes or interfaces that are diametrically offset from one another. In such embodiments, a first set of countersunk openings 18 in base ring half 32 are defined on a bottom end of the first side surface 12*a* and the interfacing surfaces of the first split 10 include aligning openings aligned with the first set of countersunk openings 18. Additionally, a second set of countersunk openings 18 are defined on the second angled surface 12*d* and interfacing surfaces of the second split 11 including aligning openings aligned with the second set of countersunk openings 18. Screws go into the bottom of the base ring half 32, near accessory surface 12*a*, through the aligned openings at the first split 10 and screws go into the top of the sight rings 30 near accessory surface 12*d* through the aligned openings at the second split 11 to connect the top ring half 34 and base ring half 32 together. The countersunk openings 18 allow for additional accessory mounting surfaces.

As illustrated in the Figures, the pair of sight rings 30 may be separate or may be connected together. In embodiments in which the sight rings 30 are separate, each sight ring 30 is adapted to be mounted to a firearm. Alternatively, the present invention may include a base plate 22 adapted to be mounted to a firearm. In such embodiments, the base ring halves 32 are integrated with and extend from an upper surface of the base plate 22. The sight rings 30 or base plate 22 may be coupled to a picatinny rail via a rail grabber 13. Screws are inserted into an opening 20 of the rail grabber 13 and into a threaded hole 21. Torquing the screw closes surfaces 15, 17 to interact with the underside of the Picatinny rail to bring surface 16 down into contact with the top of the Picatinny mounting interface.

Figure 6A:
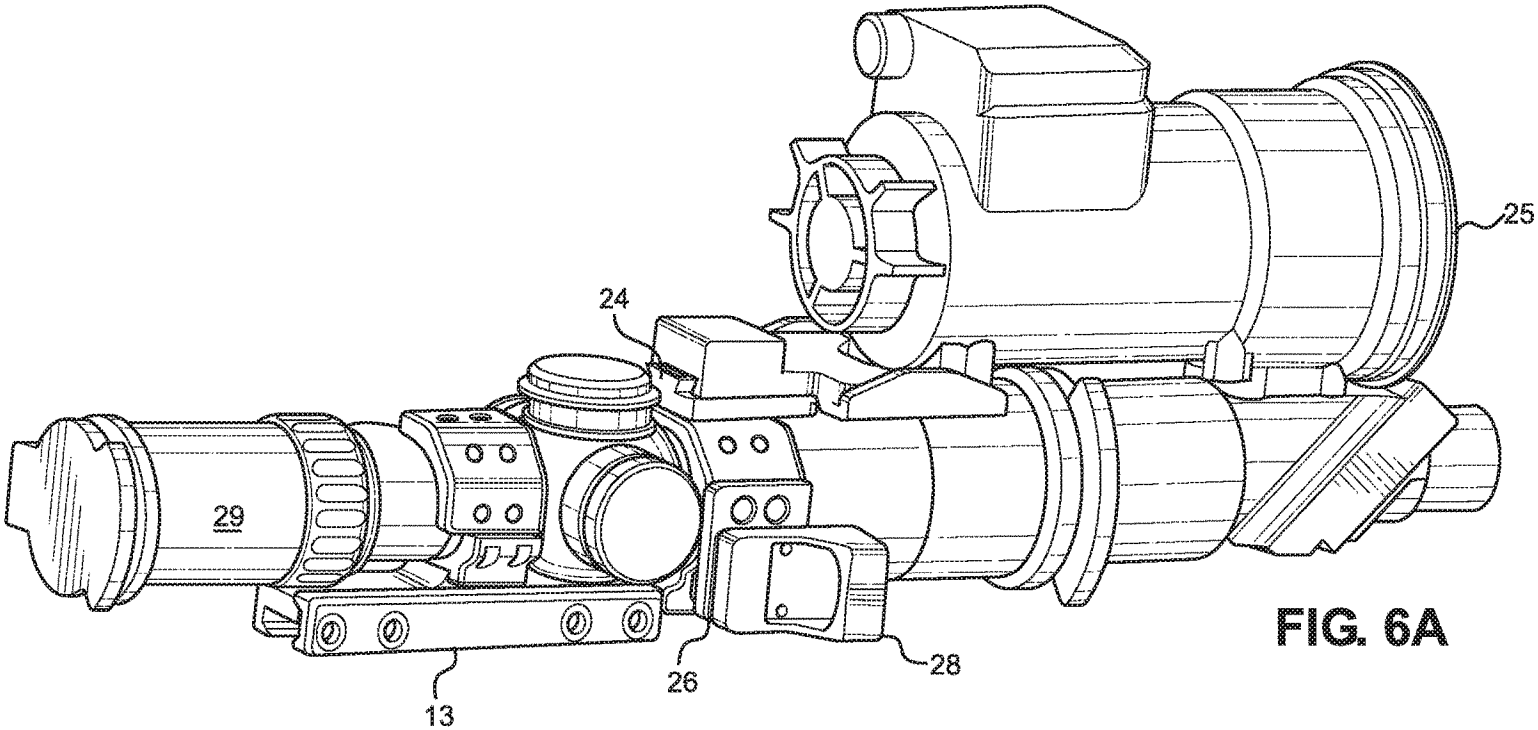
FIG. 6A is a perspective view of an embodiment of the present invention, with a scope attached.

FIG. 6A illustrates a scope mount of the embodiment of the present invention, with a cantilevered 1.5 inch offset which popular on rifles requiring a cantilever to provide proper anatomical eye relief to shooters. FIG. 6A shows a Schmidt and Bender PM II Ultra Short LP riflescope 29, (a somewhat shortened riflescope designed for night vision and thermal system integration), mounted in a scope mount of the embodiment of the present invention. A KN253 SIMRAD night vision sight 25 is interfaced to the forward ring using adaptor plate 24. A Trijicon RMR short range secondary optical reflex dot sight 28 is mounted on the right side using mount plate 26 allowing the dot to be located on the optical axis of the center of the primary optic, accessible with a forty degree roll of the rifle, without breaking the shooters cheek weld with the stock.

Figure 6B:
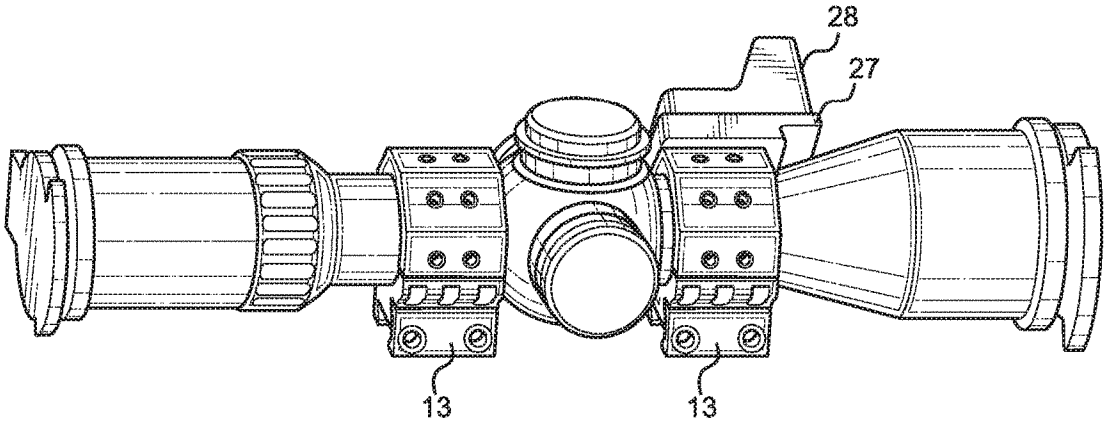
FIG. 6B is a perspective view of an embodiment of the present invention, with a scope attached.

FIG. 6B illustrates a riflescope mounted in scope rings 30 of the embodiment of the present invention. A Trijicon RMR 28 is mounted on the left side 45 degree surface using flat mounting plate 27. This assembly shows left hand shooter compatibility not afforded by other designs and displays the unparalleled versatility derived by a scope mount of the embodiment of the present invention.

It should be understood, of course, that the foregoing relates to exemplary embodiments of the invention and that modifications may be made without departing from the spirit and scope of the invention as set forth in the following claims.

What is claimed is:

1. A split ring telescopic sight mount for clamping the cylindrical tube of a telescopic sight, and operatively associating the telescopic sight rigidly to a firearm, the telescopic sight mount for fir arm comprising:

a pair of telescopic sight clamping rings each comprising:

a base ring half; and a top ring half that interfaces the base ring half at a first split and a second split, each disposed along first and second horizontal planes, respectively, wherein the first and second horizontal planes are vertically offset relative one another.

2. The telescopic sight mount of claim 1, wherein the pair of telescopic sight clamping rings each comprise a plurality of accessory mounting surfaces comprising a top surface disposed along a horizontal plane, a first side surface and a second side surface each disposed along vertical planes, and a first angled surface and a second angled surface each disposed along angled planes, whereby the plurality of accessory mounting surfaces affords a left-handed user and a right-handed user an ambidextrous layout.

3. The telescopic sight mount of claim 2, wherein each of the accessory mounting surfaces comprise openings configured to receive bolts for coupling accessory adaptor plates thereto.

4. The telescopic sight mount of claim 2, wherein the first split is disposed at a bottom of the first side surface, and the second split is disposed at a top of the second side surface.

5. The telescopic sight mount of claim 4, further comprising a first set of countersunk openings defined on a bottom end of the first side surface, wherein the interfacing surfaces of the first split comprise aligning openings aligned with the first set of countersunk openings.

6. The telescopic sight mount of claim 5, further comprising a second set of countersunk openings defined on the second angled surface, wherein the interfacing surfaces of the second split comprise aligning openings aligned with the second set of countersunk openings.

7. The telescopic sight mount of claim 6, further comprising a first set of screws inserted from a bottom of the pair of telescopic sight clamping rings and into the first set of countersunk openings and a second set of screws inserted from a top of the pair of telescopic sight clamping rings and into the second set of countersunk openings.

8. The telescopic sight mount of claim 1, wherein the pair of telescopic sight clamping rings are separate and the base ring halves are each adapted to be mounted to a firearm.

9. The telescopic sight mount of claim 1, further comprising a base plate adapted to be mounted to a firearm, wherein the base ring halves are integral with and extend from an upper surface of the base plate.

10. The telescopic sight mount of claim 1, wherein the pair of telescopic sight clamping rings are cantilevered to push a scope forward.

11. A split ring telescopic sight mount for operatively associating a telescopic sight rigidly to a firearm, the split ring telescopic sight mount comprising:

a pair of sight rings each comprising:

a base ring half; and a top ring half that interfaces the base ring half at a first split and a second split, each disposed along horizontal planes that are diametrically offset from one another.

12. The split ring telescopic sight mount of claim 11, wherein the pair of sight rings each comprise a plurality of accessory mounting surfaces comprising a top surface disposed along a horizontal plane, a first side surface and a second side surface each disposed along vertical planes, and a first angled surface and a second angled surface each disposed along angled planes, wherein each of the accessory mounting surfaces comprise openings configured to receive bolts for coupling accessory adaptor plates thereto.

13. The split ring telescopic sight mount of claim 11, wherein the first split is disposed at a bottom of the first side surface, and the second split is disposed at a top of the second side surface.

14. The split ring telescopic sight mount of claim 13, further comprising a first set of countersunk openings defined on a bottom end of the first side surface, wherein the interfacing surfaces of the first split comprise aligning openings aligned with the first set of countersunk openings.

15. The split ring telescopic sight mount of claim 14, further comprising a second set of countersunk openings defined on the second angled surface, wherein the interfacing surfaces of the second split comprise aligning openings aligned with the second set of countersunk openings.

16. The split ring telescopic sight mount sight mount of claim 15, further comprising a first set of screws inserted from a bottom of the pair of sight rings and into the first set of countersunk openings and a second set of screws inserted from a top of the pair of sight rings and into the second set of countersunk openings.

17. The split ring telescopic sight mount of claim 11, wherein the pair of sight rings are separate and the base ring halves are each adapted to be mounted to a firearm.

18. The split ring telescopic sight mount of claim 11, further comprising a base plate adapted to be mounted to a firearm, wherein the base ring halves are integral with and extend from an upper surface of the base plate.

19. The split ring telescopic sight mount of claim 11, wherein the pair of sight rings are cantilevered to push a scope forward.

20. A split ring telescopic sight mount for both operatively associating a telescopic sight rigidly to a firearm and for mounting secondary optical sighting systems to the firearm via the split ring telescopic sight mount, the split ring telescopic sight mount comprising:

a base ring half;

a top ring half that interfaces the base ring half at a first split and a second split, each disposed along horizontal planes that are offset from one another; and a plurality of accessory mounting surfaces provided along the base ring half and the top ring half, the plurality of accessory mounting surfaces oriented at forty-five degree relative to each other, whereby secondary optical sighting systems are equally supported for a left-handed user and a right-handed user.

* * * * *